US005605066A

United States Patent [19]

Hurskainen

[11] Patent Number: 5,605,066

[45] Date of Patent: Feb. 25, 1997

[54] ELECTROMECHANICAL LOCK ARRANGEMENT

[75] Inventor: Oiva Hurskainen, Joensuu, Finland

[73] Assignee: Abloy Security Ltd Oy, Helsinki, Finland

[21] Appl. No.: 41,962

[22] Filed: Apr. 1, 1993

[30] Foreign Application Priority Data

Apr. 16, 1992 [FI] Finland ..... 921713

[51] Int. Cl.[6] ..... E05B 49/00

[52] U.S. Cl. ..... 70/278; 70/277; 70/408

[58] Field of Search ..... 70/277, 278, 408

[56] References Cited

U.S. PATENT DOCUMENTS

| | | | |
|---|---|---|---|
| 1,695,518 | 12/1928 | Watson | 70/277 |
| 2,105,304 | 1/1938 | Wagner | 70/277 |
| 3,670,538 | 6/1972 | Curry | 70/277 |
| 4,031,434 | 6/1977 | Perron et al. . | |
| 4,157,534 | 6/1979 | Schachter . | |
| 4,232,353 | 11/1980 | Mosciatti et al. | 70/277 |
| 4,594,637 | 6/1986 | Falk . | |
| 4,738,334 | 4/1988 | Weishaupt . | |
| 4,789,859 | 12/1988 | Clarkson et al. . | |
| 4,798,068 | 1/1989 | Nakauchi | 70/276 |
| 4,810,861 | 3/1989 | Herriott et al. . | |
| 4,829,296 | 5/1989 | Clark et al. . | |
| 4,870,400 | 9/1989 | Downs et al. . | |
| 4,924,686 | 5/1990 | Volanthen | 70/278 |
| 4,962,449 | 10/1990 | Schlesinger . | |
| 5,140,317 | 8/1992 | Hyatt, Jr. et al. . | |

FOREIGN PATENT DOCUMENTS

| | | | |
|---|---|---|---|
| 0224607 | 6/1987 | European Pat. Off. | 70/278 |
| 243586 | 11/1987 | European Pat. Off. . | |
| 0329931 | 8/1989 | European Pat. Off. | 70/278 |
| 432392 | 6/1991 | European Pat. Off. . | |
| 2450930 | 3/1980 | France . | |
| 3437844 | 2/1986 | Germany . | |
| 3917549 | 12/1989 | Germany . | |
| 2158870 | 11/1985 | United Kingdom . | |
| 8600108 | 1/1986 | WIPO | 70/278 |
| WO02507 | 3/1989 | WIPO . | |

*Primary Examiner*—Darnell M. Boucher
*Attorney, Agent, or Firm*—Smith-Hill and Bedell

[57] ABSTRACT

The invention relates to an electromechanical lock arrangement including a lock body (1), which is provided with a cylinder lock mechanism (3) having a key channel (17) and a turnable lock cylinder (16), a dead bolt (2) movable back and forth by means of the cylinder lock mechanism (3), electrically operable latch means (7) for controlling the operation of the dead bolt (2) and a logic unit (8) for controlling said electrically operable latch means (7). The arrangement includes further a key unit (4) having a mechanical key member (4*a*) for operating the cylinder lock mechanism (3) as well as means for supplying electric power and means for sending a coded electrical signal into said logic unit (8). At the reception of a correct code the logic unit (8) is arranged to switch current to said electrically operable latch means (7) so that they allow said dead bolt (2) to be moved from its protruding locking position into its withdrawn releasing position in the lock body (1). The supplying of a code and electric power is accomplished through said mechanical key member (4*a*) at the inner end of the key channel (17) of the cylinder lock mechanism (3) by making use of a coupling arrangement, which includes a first electrically conductive coupling element (18) turnable with the lock cylinder (16) and arranged in electric contact with the mechanical key member (4*a*), and a second electrically conductive coupling element (19) stationarily installed in the lock body (1) and connected through the logic unit (8) to said electrically operable latch means (7), whereby said first coupling element (18) is by means of the mechanical key member (4*a*) arranged to be turned at the position of the second coupling element (19) for enabling said supply of a code and electric power.

8 Claims, 2 Drawing Sheets

ELECTROMECHANICAL LOCK ARRANGEMENT

Figure 1:
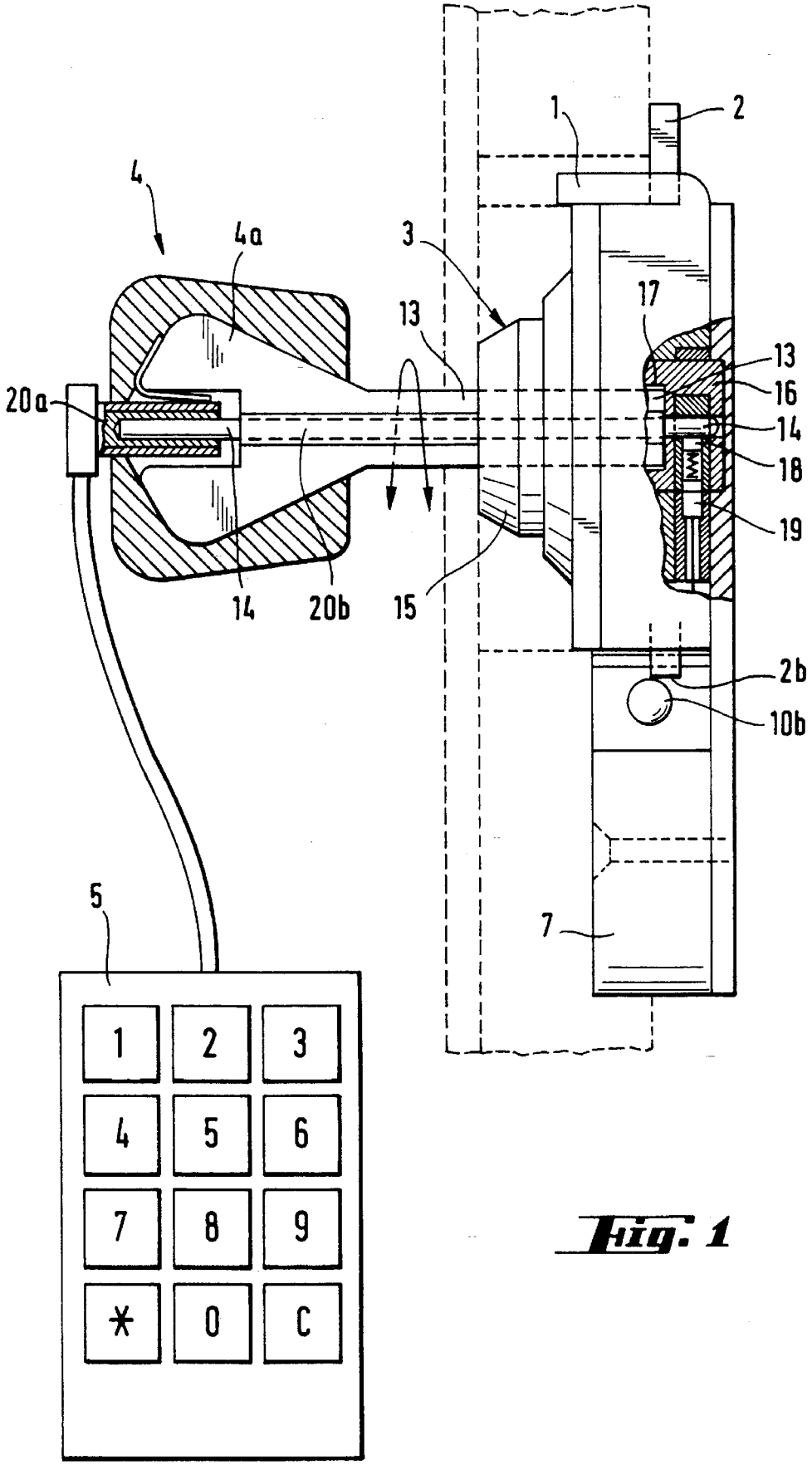

The invention relates to an electromechanical lock arrangement.

It is already known to make use of different control codes with which it can first be checked if the user of the actual lock mechanism has the right to open and, hence, the right to have an access into the locked space. Then for instance as regards a cylinder lock mechanism the arrangement includes electrically operable latch means which prevent turning of the lock cylinder until a logic unit controlling the operation of the dead bolt has received the right code.

The key, on the other hand, includes both a mechanical key member for operating the lock mechanism and means for sending a coded signal into the logic unit. In addition, depending on the application, the key can comprise also means for supplying electric power into the lock, whereby the lock itself needs no battery or the like power source. This is of advantage especially if the lock is included in a device, e.g. an automatic payphone, which does not necessarily have a power source available in its vicinity.

Also the actual supply of a code and/or energy can be accomplished with many different ways, for instance optically or by making use of induction, and naturally, also by means of two electric conductors directly connected to each other, which is a more cost effective solution than the ones mentioned above. However, a problem in the known arrangements is that said supplying operation takes place either through means located on the surface of the lock or at least in the key channel of the lock close to the key insertion opening, whereby it is exposed to misuse, dirt and other wearing conditions.

An aim of the invention is to accomplish a new electromechanical lock arrangement, from which the above mentioned drawbacks have essentially been eliminated. An aim is further to provide a solution which is uncomplicated as to its construction, secure as to operation and cost effective. A further aim is that the solution is especially suitable for locking money collecting boxes in automatic payphones, parking meters or the like stand-alone devices.

The aims can be met with an arrangement in accordance with which the supplying of a code and electric power is accomplished through said mechanical key member at the inner end of the key channel of the cylinder lock mechanism by making use of a coupling arrangement, which includes a first electrically conductive coupling element turnable with the lock cylinder, arranged in electric contact with the mechanical key member and being electrically insulated from the cylinder lock mechanism, and a second electrically conductive coupling element stationarily installed in the lock body, electrically insulated from the lock mechanism and connected through the logic unit to said electrically operable latch means, whereby said first coupling element is by means of the mechanical key member arranged to be turned at the position of the second coupling element for enabling said supply of a code and electric power. Thereby the supply means in question are under protection inside the lock mechanism itself.

Security and protection is increased by the fact that at the insertion position of the mechanical key member into the key channel connection from the code supply means and the electric power supply means through said coupling elements to the logic unit is disconnected, so that the supply only takes place after the mechanical key member is turned a certain turning angle inside the key channel into a second position. Thereby the cylinder lock mechanism must first be opened with the right key and thereafter still turned until the contact can be obtained.

In a preferred embodiment of the invention said cylinder lock mechanism is a cylinder lock with rotatable locking discs known as such, whereby the supply of a code and electric power takes place only after the lock cylinder is first released by turning the locking discs with the mechanical key member and thereafter the lock cylinder is further turned relative to the lock housing into a second position. The mechanical key member includes a wire, placed along a key shank in the key member to be inserted into the key channel of the cylinder lock mechanism, insulated from the key shank and extending a bit over the key shank, and arranged to cooperate with said first electrically conductive coupling element located at bottom of the lock cylinder.

An uncomplicated and advantageous solution is accomplished when the electrically operable latch means are in their locking position arranged to directly act on the dead bolt and to prevent movement thereof into its releasing position.

In automatic payphones or the like applications the lock body comprises a casing-like cover element, to which the cylinder lock mechanism is fixed and inside of which the dead bolt is movably installed, so that in its locking position it is arranged to extend a bit out from the cover element. With this kind of stand-alone devices it is of advantage to provide the key unit with a power source and a code selecting and supply means.

Figure 2:
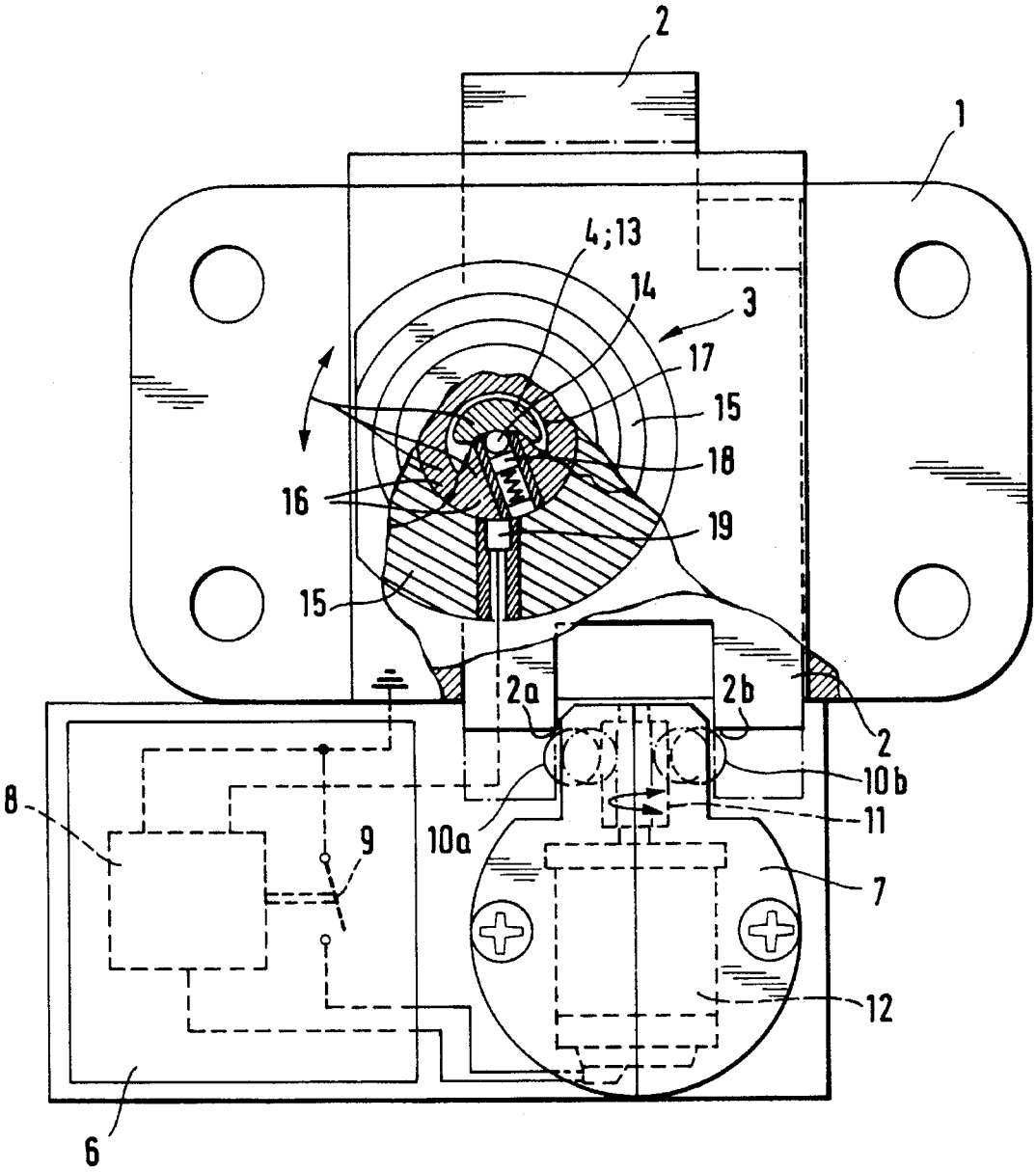

The invention will now be further described, by way of example, with reference to the accompanying drawing, in which FIG. 1 shows an electromechanical lock arrangement according to the invention as a side view, partly opened and in section, and FIG. 2 shows the arrangement of FIG. 1 as a front view and partly in section.

The lock arrangement includes a lock body 1 with a back and forth movable dead bolt 2 and a cylinder lock mechanism 3.

Movement of the dead bolt 2 between the protruding locking position and the withdrawn releasing position in the look body (shown with dotted lines in FIG. 1) takes place through the cylinder lock mechanism 3 by turning a mechanical key member 4*a* of a key unit 4 for the lock arrangement in a key channel 17 in the cylinder lock. The cylinder lock mechanism 3 can with advantage be a cylinder look with rotatable looking discs (not shown in the figure) known per se and including a lock housing 15 and inside it a turnable lock cylinder 16. For the basic functions of this kind of cylinder lock mechanism reference is made for instance to the patents U.S. Pat. No. 1,514,318 and U.S. Pat. No. 4,211,097.

The lock body includes a code identifying unit 6 with a logic unit 8 and, under the control thereof, a switch 9, which together control the operation of a latch unit 7. The latch unit includes a small electric motor 12, the nominal voltage of which is with advantage in the order of 1–15 volts and which controls a guiding member 11 supported on the shaft of the motor. The guiding member 11 has two positions in the first one of which it presses steel balls 10*a* and 10*b* serving as bolt elements into a protruding position, where they act on stop faces 2*a* and 2*b* in the dead bolt and prevent movement of the dead bolt 2 into the withdrawn position in lock body. In the second position of the guiding member 11 on the other hand it allows the balls 10*a* and 10*b* to move into the latch unit 7 so that the dead bolt 2 is free to move into its withdrawn releasing position in the lock body respectively.

As regards more detailed construction and operation of the latch unit 7 reference is made to the patent publication WO 89/11577. Naturally, instead of the electric motor 12 the operation of the latch unit 7 can be accomplished through other means e.g. through solenoid means.

Especially for automatic payphones or corresponding applications the key unit 4 includes a power source and a code selecting and supplying means, which in the. FIG. 1 are generally indicated by the reference numeral 5. By means of the code selecting and supplying means a code corresponding to each automatic payphone can separately be selected and supplied into the lock. Thereby for instance the locks of the automatic payphones within a certain area can all have the same mechanical opening combination, and as a consequence be operated by means of the same key unit.

For the actual feeding of a code and electric power a wire 14 is arranged in the mechanical key member 4*a* of the key unit, insulated from the key by insulators 20*a* and 20*b* and extending over the shank 13 of the mechanical key member. Correspondingly the turnable lock cylinder 16 includes an electrically conductive coupling element 18 turning with it but insulated therefrom and to which the key wire 14 is coupled when the mechanical key member 4*a* is inserted all the way to the bottom of the key channel 17 of the lock. The lock body 1 includes a second stationarily installed coupling element 19 to which the coupling element 18 is arranged to be coupled. This takes place after the cylinder lock mechanism 3 is first opened by means of the key member 4*a* so that the lock cylinder 16 is released to turn relative to the lock housing 15. Only then the coupling element 18 can be further turned by the mechanical key member 4*a* to the position of the coupling element 19.

After the coupling elements 18 and 19 have been arranged in contact with each other the supply of code and electric power can be accomplished. The logic unit 8 compares the code to be supplied with the code or codes programmed in the unit in a known way, because for instance every person handling the collection of money from the automatic payphone can have a code of his own. If the code is correct the logic unit closes (renders conductive) the switch 9, whereby at the same time the circuit of the latch unit 7 is energized and the balls 10*a* and 10*b* release the dead bolt 2 to moved into its releasing position by turning the key 4*a* further. Correspondingly when the dead bolt 2 is to be moved back into its locking position the key 4*a* is turned backwards, whereby at the position where the coupling elements 18 and 19 are coupled and the circuit isenergized the logic unit 8 is arranged to reverse the direction of the current so that the electrical motor 12 turns the guiding member 11 in the opposite direction and presses the balls 10*a* and 10*b* into their protruding position, whereby movement of the dead bolt 2 into the lock body 1 is again prevented.

Naturally the key unit 4 can be designed in many different ways. For instance should it be enough, depending on the application, that the key includes a preprogrammed code, no separate code selecting means are needed but the mechanical key member 4*a* can be combined with the required electronics so as to form a uniform housing which as a consequence includes also a battery as well as a register for memorizing the code.

The cylinder lock mechanism 3 can with advantage be provided with so called lightened locking discs (cf. Finnish patent n:o 63814 and the patent U.S. Pat. No. 3,942,346 corresponding thereto) which include an extra recess widening the key channel and which can be utilized so that the wire 14 together with the key shank 13 suitably fits into the key channel 17.

The design of the lock body in each case depends on the application, i.e. the space intended to be releasably locked by the lock arrangement. Therefore the design of the lock body shown in the figures is to be understood as only one example of application. For this purpose a part of the structure of a cover is additionally sketched with dotted lines in FIG. 1, into which a lock arrangement according to the invention can be installed so that it can be opened after the dead bolt 2 is released.

The invention is not limited to the embodiment shown, but several modifications thereof are feasible within the scope of the attached claims.

I claim:

1. Electromechanical lock arrangement including a lock body (1), which is provided with a cylinder lock mechanism (3) having a key channel (17) and a turnable lock cylinder (16), a dead bolt (2) movable back and forth by means of the cylinder lock mechanism (3), electrically operable latch means (7) for controlling the operation of the dead bolt (2) and a logic unit (8) for controlling said electrically operable latch means (7); the arrangement includes further a key unit (4) having a mechanical key member (4*a*) for operating the cylinder lock mechanism (3) as well as means for supplying electric power and means for sending a coded electrical signal into said logic unit (8), whereby the logic unit (8) at the reception of a correct code, is arranged to switch current to said electrically operable latch means (7) so that they allow said dead bolt (2) to be moved from its protruding locking position into its withdrawn releasing position in the lock body (1), the improvement being that said supplying of a code and electric power is accomplished through said mechanical key member (4*a*) at the inner end of the key channel (17) of the cylinder lock mechanism (3) by making use of a coupling arrangement, which includes a first electrically conductive coupling element (18) turnable with the lock cylinder (16), arranged in electric contact with the mechanical key member (4*a*) and being electrically insulated from the cylinder lock mechanism (3), and a second electrically conductive coupling element (19) stationarily installed in the lock body (1), electrically insulated from the lock mechanism and connected through the logic unit (8) to said electrically operable latch means (7), whereby said first coupling element (18) is by means of the mechanical key member (4*a*) arranged to be turned at the position of the second coupling element (19) for enabling said supply of a code and electric power.

2. Electromechanical lock arrangement according to claim 1, wherein at the insertion position of the mechanical key member (4*a*) into the key channel (17) the connection from the code supply means and the electric power supply means through said coupling elements (18,19) to the logic unit (8) is disconnected, so that the supply only takes place after the mechanical key member (4*a*) is turned a certain turning angle inside the key channel (17) into a second position.

3. Electromechanical lock arrangement according to claim 1, wherein the cylinder lock mechanism (3) is a cylinder lock with rotatable locking discs, whereby the supply of a code and electric power takes place only after the lock cylinder (16) is first released by turning the locking discs with the mechanical key member (4*a*) and thereafter the lock cylinder (16) is further turned relative to the lock housing (15) into a second position.

4. Electromechanical lock arrangement according to claim 3, wherein the mechanical key member (4*a*) includes a wire (14), placed along a key shank (13) in the key member (4*a*) to be inserted into the key channel (17) of the cylinder lock mechanism (3), insulated from the key shank (13) and extending a bit over the key shank (13), and arranged to cooperate with said first electrically conductive coupling element (18) located at bottom of the lock cylinder (16).

5. Electromechanical lock arrangement according to claim 1, wherein the electrically operable latch means (7; 10*a*, 10*b*) are in their locking position arranged to directly act on the dead bolt (2; 2*a*,2*b*) and to prevent movement thereof into its releasing position.

6. Electromechanical lock arrangement according to claim 1, wherein the lock body (1) comprises a casing-like cover element, to which the cylinder lock mechanism (3) is fixed and inside of which the dead bolt (2) is movably installed, so that in its locking position it is arranged to extend from the cover element.

7. Electromechanical lock arrangement according to claim 1, wherein the key unit (4) includes a power source and a code selecting and supply means (5).

8. Electromechanical lock arrangement according to claim 1, wherein the key unit comprises said mechanical key member and a power source and code selecting and supplying means, and wherein the key member has a shank and comprises a conductor that extends along the shank of the key member and is insulated therefrom and enters electrically conductive connection with the first electrically conductive coupling element when the key member is inserted in the cylinder lock mechanism.

* * * * *